US006450243B1

(12) United States Patent
Shaw et al.

(10) Patent No.: US 6,450,243 B1
(45) Date of Patent: Sep. 17, 2002

(54) INVESTMENT CASTING

(76) Inventors: Richard Dudley Shaw, Dunedin, High Elms Road, Downe, Kent, BR6 7JN (GB); Daniel James Duffey, 76A Ranelagh Road, Ealing, London, W5 5RP (GB)

( * ) Notice: Subject to any disclaimer, the term of this patent is extended or adjusted under 35 U.S.C. 154(b) by 3 days.

(21) Appl. No.: 09/677,757

(22) Filed: Oct. 3, 2000

(30) Foreign Application Priority Data

Mar. 17, 2000 (GB) ..... 0006581

(51) Int. Cl.[7] ..... B22C 9/04
(52) U.S. Cl. ..... 164/519; 164/516; 164/517
(58) Field of Search ..... 164/519, 516, 164/517

(56) References Cited

U.S. PATENT DOCUMENTS

| | | | |
|---|---|---|---|
| 3,654,984 | A | 4/1972 | Mellen, Jr. et al. |
| 3,751,276 | A | 8/1973 | Beyer et al. |
| 5,535,811 | A | 7/1996 | Feagin |
| 5,738,819 | A | 4/1998 | Feagin |
| 5,766,686 | A | 6/1998 | Perich et al. |
| 5,944,888 | A | 8/1999 | Perich et al. |
| 5,950,702 | A | 9/1999 | Tan et al. |

FOREIGN PATENT DOCUMENTS

| | | | |
|---|---|---|---|
| DE | 4203904 | C1 | 2/1992 |
| DE | 4203904 | C | 4/1993 |
| EP | 0244133 | A2 | 11/1987 |
| EP | 0502580 | A | 9/1992 |
| EP | 0502580 | A1 | 9/1992 |
| GB | 943488 | | 12/1963 |
| GB | 976617 | | 12/1964 |
| GB | 1278473 | | 6/1972 |
| GB | 1300954 | | 12/1972 |
| GB | 1410634 | | 10/1975 |
| GB | 1410634 | A | 10/1975 |
| GB | 1575124 | | 9/1980 |
| GB | 2294232 | A | 4/1996 |
| GB | 2294232 | A | 4/1996 |

*Primary Examiner*—Kuang Y. Lin
(74) *Attorney, Agent, or Firm*—Nixon & Vanderhye PC

(57) ABSTRACT

The present invention relates to improvements in and relating to investment casting. In particular, the invention provides a method of investment casting, comprising the steps of mixing a binder, a refractory material, and a quantity of water-insoluble organic fibers to form a slurry; coating an expendable pattern with a coat of said slurry; and drying said coat or allowing said coat to dry to form a shell. The present invention further provides a refractory slurry for use in the method of the invention, and a kit of ingredients for putting the method of the invention into effect.

24 Claims, No Drawings

INVESTMENT CASTING

FIELD OF THE INVENTION

The present invention relates to improvements in and relating to investment casting. In particular, the invention relates to a method of investment casting which involves the successive application of one or more coats of a refractory slurry to an expendable pattern, so as to build up a shell. The present invention further provides a refractory slurry for use in the method of the invention, and a kit of ingredients for putting the method of the invention into effect.

BACKGROUND TO THE INVENTION

The process of investment casting, otherwise known as the lost wax process, is well known and widely used. Typically, the process involves dipping a wax model into a slurry comprising a binder and a refractory material, so as to coat the model with a layer of slurry; applying a stucco coating of dry refractory to the surface of the layer; allowing the resulting stuccoed slurry layer to dry; and applying further stuccoed slurry layers as appropriate to create a shell mould around the wax model having a suitable thickness. After thorough drying, the wax model is eliminated from the shell mould, and the mould is fired.

Environmental considerations dictate that the binder used in the investment casting process should be water-based, rather than alcohol-based. Customarily, the binder used comprises an aqueous colloidal silica sol. When combined with a suitable refractory material into a slurry, aqueous silica sots are capable of gelling and drying to form a green shape having an acceptable degree of green strength. However, where an unmodified aqueous silica sol is used, the time taken for this process is disadvantageously long. A single stuccoed slurry layer, applied to a wax model in the course of investment casting, may take between 3–8 hours to dry. Where the model comprises recessed parts or other complex configurations, the drying time may be increased to 24 hours or more. During production of a shell mould having several stuccoed layers, this time must be multiplied by the number of coats applied. Typically, 4–8 coats are required in order to build a shell of acceptable thickness, thereby bringing the total production time to the order of between 12 hours and several days.

Considerable effort has therefore been devoted in the prior art towards accelerating the coat drying time. Thus, for example, EP-A-0638379 discloses that the addition to a colloidal silica sol binder of an elastomeric polymer, such as styrene butadiene, results in a significant reduction in the drying time and an improvement in green strength. The addition of soluble organic polymers to a colloidal silica sol binder for use in investment casting is also disclosed in U.S. Pat. No. 4,996,084. Soluble organic polymers however readily "wet out", and it has been found that the green strength of a shell mould comprising such polymers is temporarily reduced by the permeation of steam through the mould, for example during the elimination of the wax model from the mould. Moreover, soluble organic polymers are expensive, and their use in investment casting may significantly increase the cost of this process.

OBJECTS OF THE INVENTION

It remains therefore a desirable object to provide an alternative means for reducing the time required to build a shell mould of suitable thickness during the process of investment casting.

SUMMARY OF THE INVENTION

According to one aspect of the present invention, therefore, there is provided a method of investment casting, comprising the steps of mixing a binder, a refractory material, and a quantity of water-insoluble organic fibres to form a slurry; coating an expendable pattern with a coat of said slurry; and drying said coat or allowing said coat to dry to form a shell.

Optionally, a plurality of coats may be applied successively to said expendable pattern, each coat being partly or wholly dried or allowed to dry prior to the application of the next coat. Typically, between 2–10 coats, more preferably 3–8 coats, still more preferably 3, 4 or 5 coats, are successively applied to said pattern. In some embodiments, said expendable pattern is precoated in accordance with known conventional methods with a coat of slurry comprising no water-insoluble organic fibres, prior to the application in accordance with the present invention of one or more coats of fibre-modified slurry.

According to a further aspect of the present invention, there is provided a slurry comprising a binder, a refractory material and a quantity of water-insoluble organic fibres, which slurry is adapted for use in the method of the present invention.

According to yet another aspect of the present invention, there is provided a kit adapted for putting the method of the present invention into effect, said kit comprising a quantity of a binder, a quantity of a refractory material, and a quantity of water-insoluble organic fibres; said binder, refractory material and fibres being adapted to be mixed to form a slurry in accordance with the present invention. Said refractory material may be packaged and/or supplied separately from the other ingredients of the kit.

Surprisingly, the present inventors have found that a refractory slurry comprising a quantity of water-insoluble organic fibres is capable of forming significantly thicker coats around dipped objects than are slurries of the types known in the prior art. An increase in coat thickness obviously implies a concomitant decrease in the number of dipping cycles required to build a mould of sufficient thickness, and hence a significant reduction in the rate of refractory mould production. Coats of fibre-modified slurry are subject to a comparable drying time in comparison with the products of the prior art, and have been found to possess a comparable green strength.

It has furthermore been found that the efficacy of elastomer-modified binders of the kind disclosed in EP-A-0638379 and U.S. Pat. No. 4,996,084 is largely destroyed by exposure of the binders to low temperatures (0° C. and below). In contrast to the elastomer-modified compositions of the prior art, however, fibre-modified refractory slurries in accordance with the present invention have been found to be compatible with many types of antifreezes. This will therefore make possible the addition of antifreeze to binders intended for use in the fibre-modified slurries of the present invention, hence facilitating winter transport and storage of such binders.

DETAILS OF THE INVENTION

Advantageously, said fibres are dispersed in said binder prior to the addition of said refractory material. This will promote the formation of a smooth and stable slurry. However, said refractory material may alternatively be added to said binder prior to the addition of said fibres.

Optionally, said expendable pattern may be coated with said slurry by means of pouring said slurry over the pattern.

More preferably, however, said pattern may be coated by means of dipping the pattern into a receptacle containing said slurry. Conveniently, a plurality of patterns, which may for example be held on a "tree", may be dipped simultaneously into said receptacle, thereby enabling the simultaneous production of a plurality of shell moulds.

Advantageously, a plurality of coats of slurry may be applied successively to said expendable pattern. In accordance with usual practice, each coat of slurry may be stuccoed with a dry refractory material such as an aluminosilicate such as Molochite® (available from English China Clay), or mullite (available from Cermatco), or zircon, or fused silica, prior to the application of the next coat. Additionally, or in the alternative, one or more of the coats, typically one or more of the outermost coats, may be stuccoed with small polystyrene beads. This will serve to improve the insulating properties of said outermost coats. Preferably, each coat of slurry may be completely covered with a layer of said dry refractory material or said small polystyrene beads prior to the application of the next coat.

Advantageously, said method may further include the step of eliminating said expendable pattern from said shell. Said expendable pattern may conveniently be eliminated by means of heating said shell to a temperature which exceeds the melting point of said pattern such that the pattern is caused to melt, and draining the pattern from the shell. Alternatively, said pattern may be eliminated by means of heating said shell to a temperature which exceeds the sublimation or decomposition temperature of said pattern such that the pattern is caused to sublime or decompose, and causing or permitting the pattern to escape from the shell as a gas.

Where said pattern comprises a wax model, the wax may, for example, be eliminated from said shell by heating said shell in a wax autoclave, or by flash firing the wax.

Preferably, said fibres may be selected such that the step of eliminating said pattern from the shell does not cause the elimination of the fibres from the shell. Thus, where said pattern is to be eliminated by means of heating said shell to an elimination temperature which exceeds the melting point or sublimation temperature or decomposition temperature of said expendable pattern, said fibres may be selected such that the melting point of said fibres exceeds said elimination temperature. This will ensure that the fibres remain intact notwithstanding elimination of the pattern. The retention of said fibres in the shell will serve to maintain the green strength of the shell.

Typically, the melting point of said fibres may be in the region of 150–500° C., preferably 180–270° C., still more preferably 220–270° C. Such fibres may be particularly appropriate for use in conjunction with an expendable wax pattern.

The method of the present invention may further comprise the step of heating said shell to a firing temperature for firing the shell. Typically, said firing temperature may be in the range from 800° C. to 1100° C.

Advantageously, said fibres may be selected such that the melting point of said fibres is lower than said firing temperature, such that said fibres are melted when the shell is fired. Accordingly, said fibres may be eliminated from the shell during or following firing. The elimination of said fibres from the shell will serve to create porosity in the shell, thereby making possible the escape of expanding gases from the interior of the shell during the subsequent casting of molten metal therein; and hence reducing the likelihood that the shell will crack under internal gas pressure generated at this stage.

Said fibres may be spun and cut or milled in accordance with methods well known to the man skilled in the art. In preferred embodiments, the fibres used are of uniform or substantially uniform length, so as to promote the formation of a uniform slurry. Accordingly, each fibre may be less than 3 mm in length, and/or greater than 0.25 mm in length. Typically, each fibre will be between 0.25 mm and 1.5 mm in length, most preferably 1–1.5 mm in length. However, the fibres used may alternatively be of varying lengths.

In some embodiments, said quantity of fibres constitutes less than 10% by weight of the slurry. Preferably, said quantity of fibres may constitute less than 8%, more preferably less than 5% (for example, 4%, 3%, 2% or 1%), or still more preferably less than 1% (for example 0.5% or less), by weight of said slurry. The quantity of fibres used will be a factor in determining the viscosity of the slurry; and hence may be selected in each case to attain a slurry viscosity appropriate for the specific use or application intended for the slurry in that case. Where lmm fibres are used, the quantity of fibres incorporated into the slurry may advantageously be 15–20 g/l of binder. Where 0.5 mm fibres are used, the quantity of fibres incorporated into the slurry may advantageously be 5–80 g/l, preferably 20–35 g/l, of binder.

Advantageously, the diameter of each fibre may be sufficient to enable the creation of a porous structure in the shell following elimination of the fibres from the shell, so as to allow the escape of gases from the interior of the shell during metal casting. Thus, said fibres may have a denier up to 250. More preferably, said fibres may have a denier in the range 1.5–2.5; more preferably 1.8–2.1. Alternatively, said fibres may be microdenier fibres.

Said fibres may be selected such that the specific gravity of the fibres is equal to or close to the specific gravity of the binder, such that the fibres can be readily and evenly dispersed within said binder. Typically, the specific gravity of said fibres may be in the range 0.5–3, more preferably 0.5–1.5, still more preferably 1–1.5.

The fibre length, quantity of fibres, and quantity of liquid in the slurry may advantageously be selected such that the viscosity of the slurry is in the desired range. Suitably, said desired range of slurry viscosity may be 26–32 seconds measured on a B4 cup (8–12 seconds measured on a Zahn 4 cup). The desired range of slurry viscosity may however be between 10 and 180 seconds measured on a B4 cup, depending on the use to which the slurry is to be put. The viscosity of the slurry may be adjusted during use by the addition of deionised water, in order to compensate for evaporation losses.

Said fibres may, for example, comprise polypropylene fibres. Alternatively, said fibres may comprise other organic water-insoluble fibres such as acrylic, polyester, modified acrylic, nylon, or viscose/rayon fibres. The attributes of these fibres are set out in Table 1.

TABLE 1

| Fibre type | Specific gravity | Melting point (° C.) | Resistance to acid | Resistance to alkali |
|---|---|---|---|---|
| Acrylic | 1.17 | 290 | Good | Fair |
| Polypropylene | 0.91 | 165 | Good | Good |
| Modified Acrylic | 1.38 | 185 | Good | Fair |

TABLE 1-continued

| Fibre type | Specific gravity | Melting point (° C.) | Resistance to acid | Resistance to alkali |
|---|---|---|---|---|
| Nylon ® | 1.14 | 252 | Fair | Good |
| Viscose/ Rayon | 1.52 | 155 | Poor | Poor |
| Polyester | 1.38 | 234 | Good | Fair |

Most preferably, fibres with good distributive properties may be used, such as Nylons® or polyester fibres. The above list of fibres is not exhaustive, and any water-insoluble organic fibre with suitable properties known to the skilled man may be used. In particular, bi-component fibres, comprising two or more fibre types woven or welded into each single bi-component fibre strand, may advantageously be used.

Optionally, said slurry may comprise further ingredients, for modifying or improving the properties of the slurry. For example, said slurry may comprise an antifoaming agent, such as an antifoaming agent based on dimethylpolysiloxane, such as WEX proprietory product A10, which is commercially available from WEX Chemicals, ICG House, Station Approach, Oldfield Lane North, Greenford, Middlesex UB6 OAL, England. Additionally or alternatively, said slurry may comprise elastomers and/or water-soluble polymers such as styrene butadiene latex. Said slurry may also comprise one or more wetting agents, such as bis(polyoxyethylene) 2-ethylhexylphosphate (commercially available under the Registered Trade Mark VICTAWET).

In some embodiments, a a quantity of graphite and/or antracite particles and a quantity of fused silica may be incorporated in said slurry. Optionally, said graphite and/or antracite particles and fused silica may be incorporated in said slurry only prior to the application of the outermost coat or coats to said model. The graphite will serve to increase the strength of said coat or coats during wax melt out and drying. The presence of fused silica, having a low thermal conductivity, will serve to improve the insulating properties of the outermost coat or coats.

In particularly preferred embodiments, said binder comprises a colloidal silica sol. Said silica sol may be alkaline, and may for example have a pH in the range 9.3–10.5, preferably 10.1–10.5. Alternatively, said silica sol may be acidic, whether triple deionised or not. Said silica sol may comprise 10– 50% wt/wt silica, typically 20–30% wt/wt silica. Suitable binders for this purpose are widely available commercially; for example LUDOX® (available from Du Pont), or WEXCOAT® (available from Wex Chemicals at the address given above). Optionally, further components such as phosphates may be included in said binder.

Alternatively, said binder may comprise an acid or alkali hydrolysed ethyl silicate binder, of the kind known in the art.

Said refractory may comprise aluminosilicates, magnesia, zircon, fused silica and/or other refractory materials well-known to the man skilled in the art. Typically, the amount of refractory used may comprise 100–500% wt/wt, more preferably 100–200% wt/wt, still more preferably about 150% wt/wt, of said binder.

EXAMPLES

Following is a description, by way of example only, of embodiments of the present invention and methods for putting the invention into effect.

Example 1

A slurry in accordance with the invention was produced from the following components:

Silica Sol Binder

An aqueous silica sol comprising 24% $SiO_2$, having an specific gravity (relative density) of approximately 1.167 and a nominal particle size of 10 nm at a pH of 10.2, and 0.5% wt/wt antifoam (WEX antifoam A10).

Refractory

−200 mesh Molochite® (calcined aluminosilicate, commercially available from English China Clays).

Water-insoluble Organic Fibres

Nylon® fibres; 1.8 denier, 1 mm length.

The slurry was produced as follows. 20 g of Nylons® fibres were added to 1.170 kg of the silica sol binder and mixed to disperse the fibres therein. 1.755 kg of refractory (3:2 wt/wt ratio of refractory: binder) was added to the resulting fibre-modified binder. The resulting mix was stirred thoroughly to produce a slurry (0.68% wt/wt fibre: slurry). Following thorough agitation and dispersion, the viscosity of the slurry was tested using a Zahn 4 viscosity measuring cup (result: 10 seconds) and a B4 viscosity measuring cup (result: 30 seconds), in accordance with standard methods.

The slurry was used in accordance with the method of the present invention to coat a plurality of wax test bars of the kind routinely employed in British Standard test procedure BS 1902. Each bar comprised an oblong block of wax measuring approximately 20 cm by 2.5 cm by 0.7 cm.

The bars were initially chemically cleaned, washed and dried in accordance with normal good practice, and were pre-coated with a refractory slurry comprising a silica sol binder, a zircon sand refractory, and a water soluble polymer, but containing no insoluble organic fibres; stuccoed; and dried. Each bar was then dipped into the fibre-modified slurry described above, held for a period of 10–20 seconds, and removed. Each bar was immediately stuccoed with Molochite® 30/80 mesh grain and then placed under a fan for 1 hour for drying.

After drying, a second coat was applied to each bar. Each bar was re-dipped as described above, stuccoed with Molochite® 16/30 mesh grain, and dried for one hour. Four further coats of slurry and Molochite® 16/30 mesh grain were subsequently applied to each bar in this manner, each coat being allowed a drying time of 1 hour. Thus, a total of six coats were applied to each bar within the course of an 8-hour working day.

The coated bars were allowed to dry thoroughly overnight. Thereafter, each bar was placed in an autoclave at 8 bar pressure and 180° C., such that the wax was melted out to leave a refractory shell. The shells were found to have an average thickness of approximately 8 mm; that is, about 20% greater than the average thickness of shells formed under identical conditions from slurries comprising soluble organic polymers, of the kind known in the prior art.

The permeability of the shells produced in accordance with the method described above was found to be comparable with that of shells available in the prior art. Moreover the strength per unit thickness of each shell produced as above was found to be at least equivalent to that of shells previously available; each shell having a green MOR (modulus of rupture) of approximately 3.5 MPa or 502.8 psi. The presence of intact Nylon® fibres in the finished shell served to improve the green strength thereof.

The drying time required for each coat of fibre-modified slurry was also comparable with drying times of elastomer-modified prior art slurries. It is noted that the rate of drying may be increased by the addition of magnesia grain, such as 30/80 calcined MgO, to the stucco.

Shells made in accordance with the method described above were fired at 1000° C. for approximately 1 hour, and were thereafter ready for casting with metal.

Example 2

A slurry in accordance with the invention was produced from the following components:

Silica Sol Binder

An aqueous silica sol comprising 24% $SiO_2$, having an specific gravity (relative density) of approximately 1.167 and a nominal particle size of 10 nm at a pH of 10.2, and 0.5% wt/wt antifoam.

Refractory

−200 mesh Molochite® (calcined aluminosilicate, commercially available from English China Clays).

Water-insoluble Organic Fibres

Polypropylene fibres; 1.8 denier, 1 mm length.

The slurry was produced as follows. 63 g of polypropylene fibres were added to 3.5 liters (4.08 kg) of the silica sol binder (18 g fibres/liter of binder)and mixed to disperse the fibres therein. 6.13 kg of refractory (3:2 wt/wt ratio of refractory:binder) was added to the resulting fibre-modified binder. The resulting mix was stirred thoroughly to produce a slurry. Following thorough agitation and dispersion, the viscosity of the slurry was tested using a Zahn 4 viscosity measuring cup (result: 10 seconds) and a B4 viscosity measuring cup (result: 30 seconds), in accordance with standard methods The slurry was used in accordance with the method of the present invention to coat a plurality of wax test bars of the kind routinely employed in British Standard test procedure BS 1902. Each bar comprised an oblong block of wax measuring approximately 20 cm by 2.5 cm by 0.7 cm.

The bars were initially chemically cleaned, washed and dried in accordance with normal good practice, and were pre-coated with a refractory slurry comprising a silica sol binder, a zircon sand refractory, and a water soluble polymer, but containing no insoluble organic fibres; stuccoed; and dried. Each bar was then dipped into the fibre-modified slurry described above, held for a period of 10–20 seconds, and removed. Each bar was immediately stuccoed with Molochite® 30/80 mesh grain and then placed under a fan for 1 hour for drying.

After drying, a second coat was applied to each bar. Each bar was re-dipped as described above, stuccoed with Molochite® 16/30 mesh grain, and dried for one hour. Four further coats of slurry and Molochite® 16/30 mesh grain were subsequently applied to each bar in this manner, each coat being allowed a drying time of 1 hour. Thus, a total of six coats were applied to each bar within the course of an 8-hour working day.

The coated bars were allowed to dry thoroughly overnight. Thereafter, each bar was placed in an autoclave at 8 bar pressure and 180° C., such that the wax was melted out to leave a refractory shell. The shells were found to have an average thickness of approximately 8 mm; that is, about 20% greater than the average thickness of shells formed under identical conditions from slurries comprising soluble organic polymers, of the kind known in the prior art. During the autoclaving process, the polypropylene fibres, having a relatively low melting point, melted out of the shell, hence yielding a shell with a somewhat diminished green strength.

The permeability of the shells produced in accordance with the method described above was found to be comparable with that of shells available in the prior art. Moreover the strength per unit thickness of each shell produced as above was found to be at least equivalent to that of shells previously available; each shell having a green MOR (modulus of rupture) of approximately 3.5 MPa or 502.8 psi.

The drying time required for each coat of fibre-modified slurry was also comparable with drying times of elastomer-modified prior art slurries. It is noted that the rate of drying may be increased by the addition of magnesia grain, such as 30/80 calcined MgO, to the stucco.

Shells made in accordance with the method described above were fired at 1000° C. for approximately 1 hour, and were thereafter ready for casting with metal.

What is claimed is:

1. A method of investment casting, comprising the steps of mixing a binder, a refractory material, and a quantity of water-insoluble organic fibers to form a slurry; coating an expendable pattern with one or more coats of said slurry; and drying said one or more coats or allowing said one or more coats to dry to form a shell mold; wherein said slurry has a viscosity in the range 10–180 seconds measured on a B4 cup and said fibers comprise organic fibers having a length of less than 3 mm.

2. The method recited in claim 1, wherein the fibers are dispersed in said binder prior to the addition of said refractory material to form said slurry.

3. The method recited in claim 1, wherein said expendable pattern is coated with between 2–10, preferably between 3–5, coats of said slurry.

4. The method recited in claim 1, further comprising the step of stuccoing each coat with a layer of a dry refractory material before the application of the next coat.

5. The method recited in claim 1, further comprising the step of removing said expendable pattern from said shell mold, optionally by heating said shell mold to a temperature exceeding the melting point, or sublimation or decomposition temperature, of said pattern, such that the pattern is caused to melt, sublime or decompose, and causing or allowing said pattern to escape from the shell mold.

6. The method recited in claim 1, further comprising the step of heating said shell mold to a firing temperature for firing said shell mold.

7. The method recited in claim 6, wherein said fibers are arranged to be eliminated from said shell mold during firing of said shell mold.

8. The method recited in claim 7, wherein the melting point of said fibers is lower than said firing temperature, such that the fibers are caused to melt during firing of said shell mold.

9. The method recited in claim 1, wherein the melting point of said fibers exceeds the melting point or decomposition or sublimation temperature of said pattern.

10. The method recited in claim 1, wherein the quantity of water in said slurry is selected such that the slurry has a viscosity in the range 26–32 seconds, measured on a B4 cup.

11. The method recited in claim 1, wherein said fibers have a denier no greater than 250.

12. The method recited in claim 11, wherein said fibers have a denier in the range 1.5–2.5 preferably 1.8–2.1.

13. The method recited in claim 1, wherein the length of said fibers is greater than 0.25 mm, preferably between 1–1.5 mm.

14. The method recited in claim 1, wherein the specific gravity of said fibers is in the range 0.5–3, preferably in the range 1–1.5.

15. The method recited in claim 1, wherein said water-insoluble organic fibers comprise polypropylene, acrylic, polyester, modified acrylic, Nylon® or viscose rayon fibers.

16. The method recited in claim 1, wherein said water-insoluble organic fibres comprise bi-component fibers comprising two or more fiber types woven or welded into each single bi-component fiber strand.

17. The method recited in claim 1, wherein said quantity of fibers constitutes less than 10%, preferably less than 5%, still more preferably less than 1%, most preferably less than 0.5%, by weight of said slurry.

18. The method recited in claim 1, further comprising the step of incorporating in said slurry a quantity of elastomers and/or water-soluble polymers.

19. The method recited in claim 1, further comprising the step of incorporating in said slurry a quantity of an anti-foaming agent such as dimethylpolysiloxane.

20. The method recited in claim 1, further comprising the step of incorporating in said slurry a quantity of an anti-freeze.

21. The method recited in claim 1, further comprising the step of incorporating in said slurry a quantity of one or more wetting agents.

22. The method recited in claim 1, wherein said binder comprises a colloidal silica sol or an acid or alkali hydrolyzed ethyl silicate binder.

23. The method recited in claim 1, wherein said refractory comprises aluminosilicates, magnesia and/or zircon.

24. The method recited in claim 1, further comprising the step of incorporating in said slurry a quantity of graphite and/or antracite particles a quantity of fused silica.

* * * * *